US011253417B2

(12) United States Patent
Cerilli

(10) Patent No.: US 11,253,417 B2
(45) Date of Patent: Feb. 22, 2022

(54) WALKER APPARATUS

(71) Applicant: Darling June, PBC, Orange, CT (US)

(72) Inventor: Anna Cerilli, Orange, CT (US)

(73) Assignee: Darling June, PBC, Orange, CT (US)

( * ) Notice: Subject to any disclaimer, the term of this patent is extended or adjusted under 35 U.S.C. 154(b) by 0 days.

(21) Appl. No.: 16/832,657

(22) Filed: Mar. 27, 2020

(65) Prior Publication Data

US 2020/0306121 A1 Oct. 1, 2020

Related U.S. Application Data

(60) Provisional application No. 62/826,654, filed on Mar. 29, 2019.

(51) Int. Cl.

| | |
|---|---|
| ***A61H 3/04*** | (2006.01) |
| ***A61G 5/08*** | (2006.01) |
| *A45B 9/04* | (2006.01) |

(52) U.S. Cl.

CPC ..... *A61H 3/04* (2013.01); *A61G 5/0866* (2016.11); *A45B 9/04* (2013.01); *A61H 2003/046* (2013.01)

(58) Field of Classification Search

CPC ..... A61H 3/04; A61G 5/0866; A45B 9/04
See application file for complete search history.

(56) References Cited

U.S. PATENT DOCUMENTS

| | | | | |
|---|---|---|---|---|
| 2,872,967 | A * | 2/1959 | Kirkpatrick | A61H 3/04 297/5 |
| 4,907,794 | A | 3/1990 | Rose | |
| D310,646 | S | 9/1990 | Rose | |
| D312,061 | S | 11/1990 | Smith | |
| 5,046,748 | A * | 9/1991 | Oat-Judge | B62B 5/049 280/47.34 |
| D372,890 | S | 8/1996 | Ferm et al. | |
| D375,708 | S | 11/1996 | Ahlbertz | |
| 5,603,517 | A * | 2/1997 | Lorman | A61H 3/04 135/67 |
| 5,605,169 | A * | 2/1997 | Light | A61H 3/04 135/66 |
| 5,605,345 | A | 2/1997 | Erfurth et al. | |
| 5,772,234 | A * | 6/1998 | Luo | A61G 5/00 280/47.38 |

(Continued)

FOREIGN PATENT DOCUMENTS

| | | | |
|---|---|---|---|
| CN | 100534406 | C | 9/2009 |
| JP | 3106179 | U | 12/2004 |
| WO | WO-2002/022070 | A2 | 3/2002 |

OTHER PUBLICATIONS

International Search Report and Written Opinion for International Application No. PCT/US2020/025371 dated Jun. 12, 2020.

*Primary Examiner* — Erez Gurari
(74) *Attorney, Agent, or Firm* — Stephen J. Kenny; Foley Hoag LLP

(57) ABSTRACT

A foldable walker having an arcuate front and rear leg frames pivotably connected by a hinge which permits the two leg frames to covert from an open configuration, with the front wheels engaging the ground and spaced a first distance from the rear wheels, to a folded configuration with the front wheels closer to the rear wheels. The walker includes a seat which can convert from a horizontal seat position to a vertical backrest position, and a height adjustable and pivotable foot rest.

19 Claims, 16 Drawing Sheets

(56) References Cited

U.S. PATENT DOCUMENTS 5,927,441 A * 7/1999 Luo ..... B62B 5/04 188/19
6,311,708 B1 * 11/2001 Howie ..... A61H 3/04 135/67
6,494,469 B1 * 12/2002 Hara ..... A61H 3/04 135/67
D519,423 S 4/2006 Tolfsen
7,628,411 B2 12/2009 Meyers et al.
8,220,823 B2 * 7/2012 Queen ..... B62B 9/28 280/650
8,511,694 B2 8/2013 Bradshaw et al.
D696,162 S 12/2013 Skafdrup et al.
D703,107 S 4/2014 Moller
8,708,363 B1 * 4/2014 Chang ..... A61H 3/04 280/642
8,936,256 B2 1/2015 Liu
9,339,432 B2 5/2016 Liu et al.
9,415,635 B2 8/2016 Liu
9,585,807 B2 3/2017 Fellingham et al.
9,662,264 B2 5/2017 Jacobs
D789,255 S 6/2017 Delatorre et al.
9,707,148 B1 7/2017 McGuire
9,744,094 B2 8/2017 Liu et al.
9,763,849 B2 9/2017 Paterson et al.
9,770,380 B1 9/2017 Dalton
D798,777 S 10/2017 Lin
D798,778 S 10/2017 Lin
9,775,767 B1 10/2017 Khaligh
9,808,394 B1 * 11/2017 Jiang ..... A61H 3/00
D805,440 S * 12/2017 Kavanagh ..... D12/130
9,833,377 B2 12/2017 Smed
D814,363 S 4/2018 VanAusdall
D816,556 S 5/2018 Parr
9,968,507 B2 5/2018 Rabin et al.
10,016,324 B1 7/2018 Howard
10,053,062 B2 8/2018 Liu
10,111,803 B2 10/2018 Julian et al.
D836,499 S 12/2018 Delatorre et al.
D836,500 S 12/2018 Julian et al.
D837,697 S 1/2019 Luo
D840,877 S 2/2019 Michelena et al.
10,231,520 B2 3/2019 Kudronowicz
D845,841 S 4/2019 No-Young
10,292,891 B2 5/2019 Zheng et al.
D851,543 S 6/2019 Janeczek et al.
10,307,321 B2 6/2019 Pan et al.
D857,561 S 8/2019 Berman et al.
10,391,018 B1 8/2019 Fitzwater
D858,366 S * 9/2019 VanAusdall ..... D12/130
10,406,061 B1 9/2019 January
D861,544 S 10/2019 January
D865,575 S 11/2019 Lin
10,470,963 B1 11/2019 Donahoe et al.
D869,347 S 12/2019 Huang
10,500,121 B2 12/2019 Triolo et al.
10,543,144 B2 1/2020 Johnson et al.
D874,351 S 2/2020 Fellingham et al.
10,555,866 B2 2/2020 Pan et al.
10,583,065 B1 3/2020 Mejia
10,583,066 B1 3/2020 Abroms
10,617,592 B2 4/2020 Fellingham et al.
D883,861 S 5/2020 Mejia
2002/0070533 A1 * 6/2002 Owens ..... A61H 3/04 280/650
2005/0001398 A1 * 1/2005 Serhan ..... A61H 3/04 280/87.01
2007/0283990 A1 * 12/2007 Fernandez ..... A61G 5/128 135/67
2008/0093826 A1 * 4/2008 Willis ..... A61G 5/0883 280/650
2008/0129016 A1 * 6/2008 Willis ..... A61G 5/08 280/639
2010/0263697 A1 * 10/2010 Catton ..... A61H 3/00 135/67
2013/0181489 A1 * 7/2013 Serhan ..... B60T 7/14 297/129
2013/0292916 A1 * 11/2013 Nabeta ..... A61H 3/04 280/47.371
2014/0265188 A1 * 9/2014 Chang ..... A61G 5/1037 280/47.4
2015/0048598 A1 * 2/2015 Freeman ..... A61H 3/04 280/639
2016/0106617 A1 4/2016 Wobith et al.
2018/0369059 A1 * 12/2018 Shirley ..... A61H 3/04
2021/0038451 A1 * 2/2021 Wang ..... A61G 5/085

* cited by examiner

WALKER APPARATUS

BACKGROUND OF THE DISCLOSED SUBJECT MATTER

Field of the Disclosed Subject Matter

The disclosed subject matter relates to an apparatus and system for enhanced and supported youth mobility. Particularly, the present disclosed subject matter is directed towards an apparatus that facilitates movement and rehabilitation of youth by providing a mobile and convertible weight-bearing seated, and walking assisted, structure.

Description of Related Art

A variety of methods and systems are known for assisting children in walking, including individual canes or crutches, as well as walker frames (stationary, or with wheels on front legs) to ambulate. The frame surrounds the child on three sides, and extends outwardly from the body to provide the child unhindered movement within the frame during gait. The frame typically contacts the ground at three or four points to provide enhanced lateral, forward and backward stability for the child.

Such conventional systems generally have been considered satisfactory for their intended purpose, however, these typically require the child to sufficient strength and coordination to support their own weight during transit. Moreover, traditional walker frames are large in size (e.g. extend to at least the user's waist) and formed of rigid materials having a fixed interconnection of components resulting in cumbersome devices that are difficult to handle and store when not in use.

There thus remains a need for an apparatus which facilitates individual (e.g. children) movement and provides a convertible seating mechanism which can support the child's weight when seating is desired, and repositioned to avoid inhibiting the child's gait when walking is desired.

SUMMARY OF THE DISCLOSED SUBJECT MATTER

The purpose and advantages of the disclosed subject matter will be set forth in and apparent from the description that follows, as well as will be learned by practice of the disclosed subject matter. Additional advantages of the disclosed subject matter will be realized and attained by the methods and systems particularly pointed out in the written description and claims hereof, as well as from the appended drawings.

To achieve these and other advantages and in accordance with the purpose of the disclosed subject matter, as embodied and broadly described, the disclosed subject matter includes a foldable walker apparatus comprising: a front leg frame, the front leg frame including: a first front leg, the first front leg having at least one wheel coupled thereto, a second front leg, the second front leg having at least one wheel coupled thereto; a first cross beam, the first cross beam connecting the first front leg to the second front leg; a rear leg frame, the rear leg frame including: a first rear leg, the first rear leg having at least one wheel coupled thereto, a second rear leg, the second rear leg having at least one wheel coupled thereto; a second cross beam, the second cross beam connecting the first rear leg to the second rear leg; a hinge, the hinge pivotably coupling the front leg frame to the rear leg frame; an upper frame, the upper frame including: a left side arm having a handle at the distal end, a right side arm having a handle at the distal end, a third cross beam, the third cross beam connecting the left side arm to the right side arm; and wherein the apparatus can be converted between an open configuration with the front wheel(s) spaced a first distance from the rear wheel(s), and a folded configuration in which the front wheel(s) are spaced a second distance from the rear wheel(s).

In some embodiments, the foldable walker includes a support surface pivotably coupled to the left and right side arms, the support surface convertible from a horizontal seat position to a vertical backrest position.

In some embodiments, the foldable walker includes a foot rest, the foot rest coupled to a height adjustment mechanism. In some embodiments, the foot rest is pivotably adjustable. In some embodiments, the foot rest is positioned parallel to the support surface when the support surface is in the horizontal seat position. In some embodiments, the height adjustment mechanism is coupled to the left and right side arms of the upper frame.

In some embodiments, the first front leg, second front leg and first cross beam are integrally formed. In some embodiments, the foldable walker includes the first rear leg, second rear leg and second cross beam are integrally formed.

In some embodiments, the hinge is disposed on the front leg frame.

In some embodiments, the foldable walker includes an actuator, the actuator releasably locking the front leg frame with respect to the rear leg frame between open and folded configurations. In some embodiments, the actuator is disposed on the first cross beam.

In some embodiments, the wheels are swiveling casters, include a break mechanism, and/or are removable.

In some embodiments, the first cross beam is disposed vertically between the second cross beam and the third cross beam.

In some embodiments, the first rear leg of the rear leg frame is disposed laterally outward from the first front leg of the front leg frame.

In some embodiments, the handles are adjustable in pitch, yaw and roll directions.

In some embodiments, the first front leg and second front leg of the front leg frame are arcuate in shape.

In some embodiments, the first rear leg and second rear leg of the rear leg frame are arcuate in shape.

In some embodiments, the foldable walker includes a steering extension beam, the steering extension beam extending upwardly and rearwardly from the third cross beam.

It is to be understood that both the foregoing general description and the following detailed description are exemplary and are intended to provide further explanation of the disclosed subject matter claimed.

The accompanying drawings, which are incorporated in and constitute part of this specification, are included to illustrate and provide a further understanding of the method and system of the disclosed subject matter. Together with the description, the drawings serve to explain the principles of the disclosed subject matter.

BRIEF DESCRIPTION OF THE DRAWINGS

A detailed description of various aspects, features, and embodiments of the subject matter described herein is provided with reference to the accompanying drawings, which are briefly described below. The drawings are illustrative and are not necessarily drawn to scale, with some components and features being exaggerated for clarity. The drawings illustrate various aspects and features of the present subject matter and may illustrate one or more embodiment(s) or example(s) of the present subject matter in whole or in part.

DETAILED DESCRIPTION OF AN EXEMPLARY EMBODIMENT

Reference will now be made in detail to exemplary embodiments of the disclosed subject matter, an example of which is illustrated in the accompanying drawings. The method and corresponding steps of the disclosed subject matter will be described in conjunction with the detailed description of the system.

Figure 1:
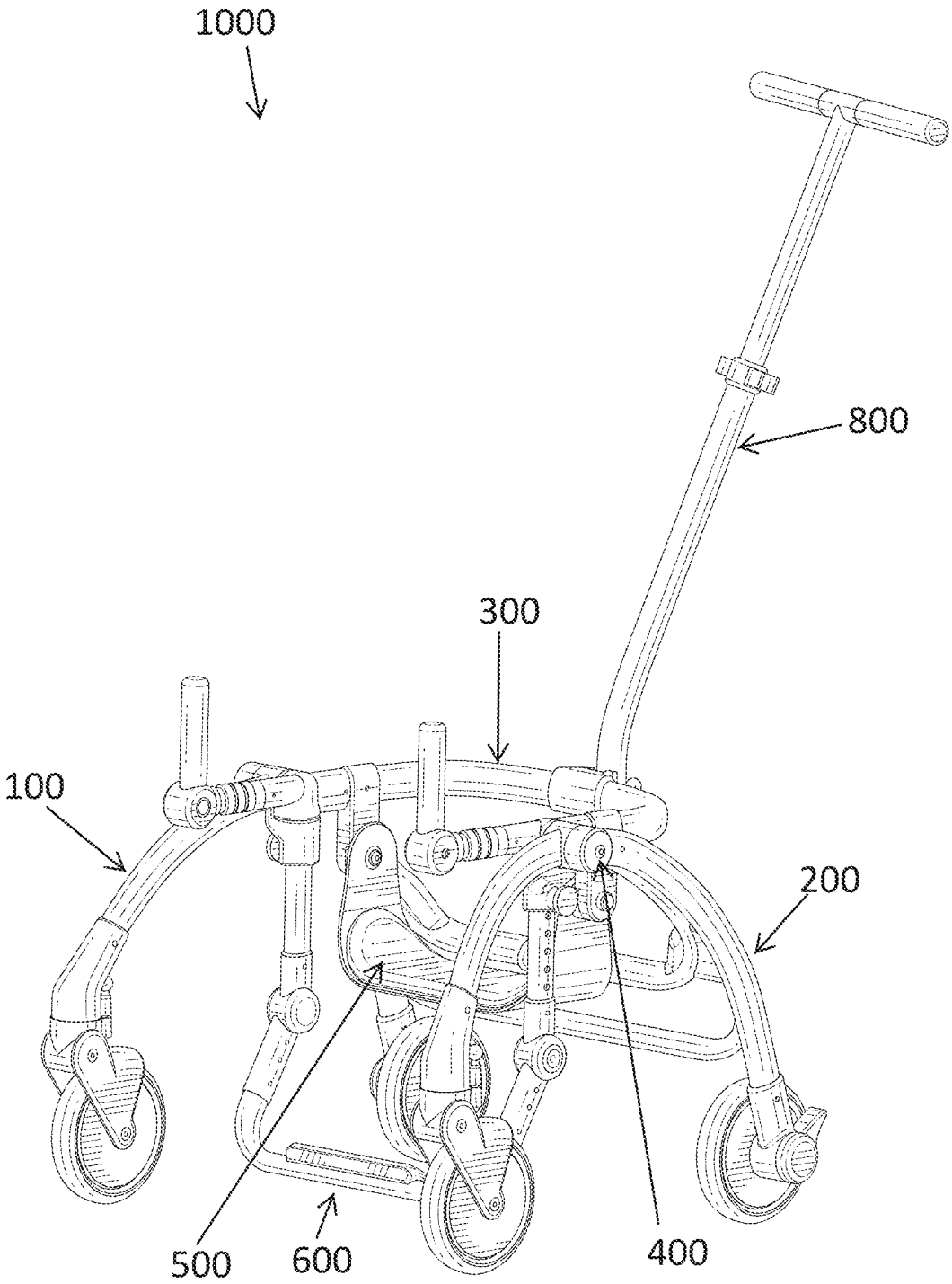
FIG. 1 is a schematic representation of a perspective view of the foldable walker apparatus, shown in the open position, in accordance with the disclosed subject matter.
Figure 2:
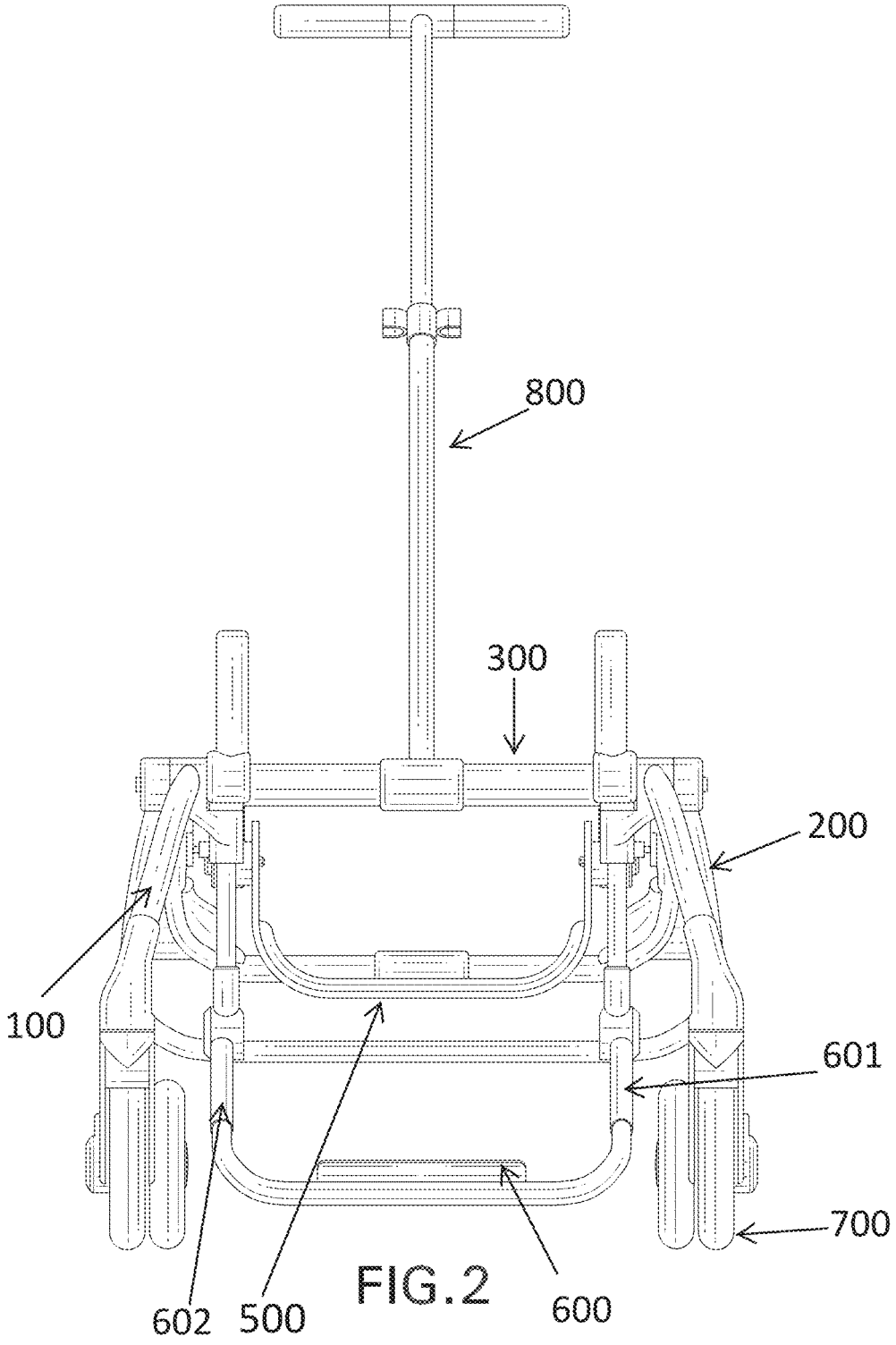
FIG. 2 is a front view of the foldable walker apparatus.

The methods and systems presented herein may be used for assisting and supporting child mobility. The disclosed subject matter is particularly suited for providing both a seated mobile support system and assisted walker, all in a system that is convertible between open and closed (or folded) configurations for ease storage and handling. For purpose of explanation and illustration, and not limitation, an exemplary embodiment of the system in accordance with the disclosed subject matter is shown in FIG. 1 and is designated generally by reference character 1000. Similar reference numerals (differentiated by the leading numeral) may be provided among the various views and Figures presented herein to denote functionally corresponding, but not necessarily identical structures.

As shown in FIG. 1, the system 1000 generally includes a walker having a front leg frame 100, a rear leg frame 200 an upper frame 300, a hinge 400 connecting the front and rear frames, an adjustable support surface 500 for supporting a user, an adjustable footrest 600, and wheels 700. Additionally, a steering extension 800 can be included for adult assistance/control in propelling the walker.

Front Leg Frame 100

Figure 9:
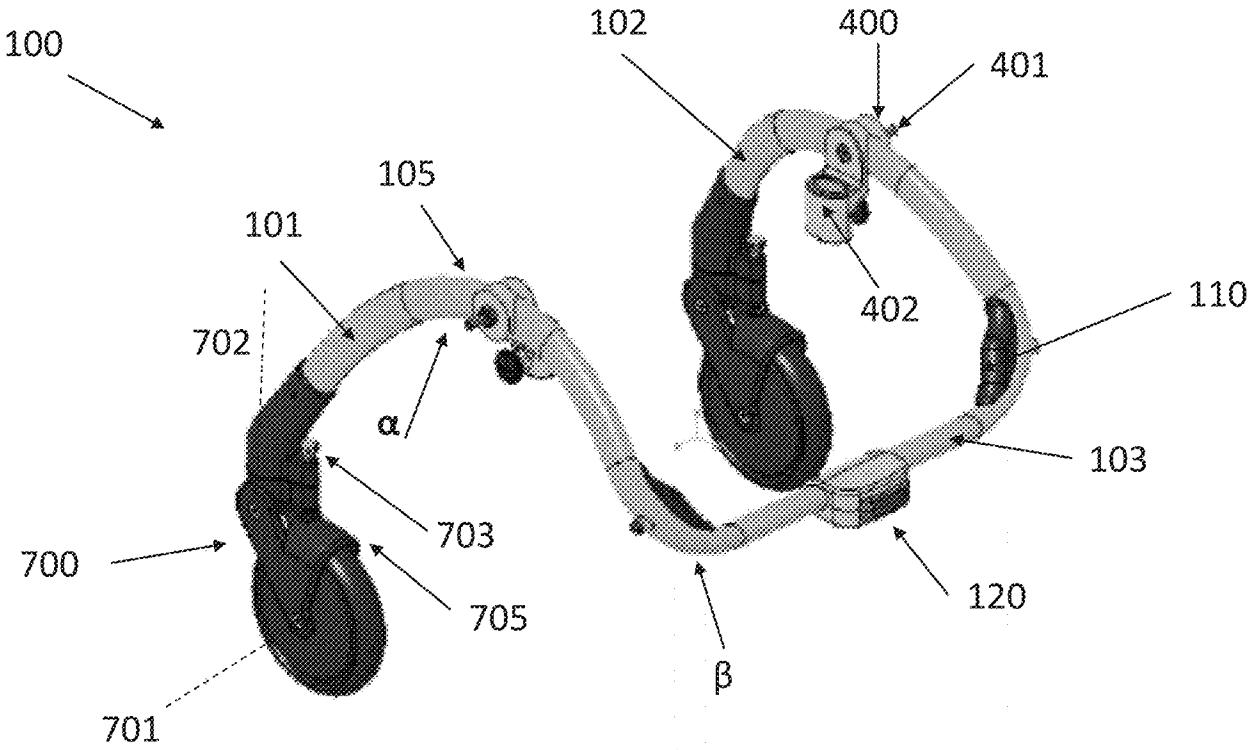
FIG. 9 is an isolated and perspective view of the front leg frame of the foldable walker apparatus.

An exemplary embodiment of the front leg frame 100 is shown, in isolation for clarity in FIG. 9, as having a first and second front legs 101, 102, respectively. The front leg frame 100 also includes first cross beam 103 extending between and connecting the front legs 101, 102. As shown, these components can be integrally formed as a single unit. Alternatively, these components can be formed individually and joined (e.g. welded, adhesive, mechanical fasteners, etc.) into a sub-assembly.

Figure 4:
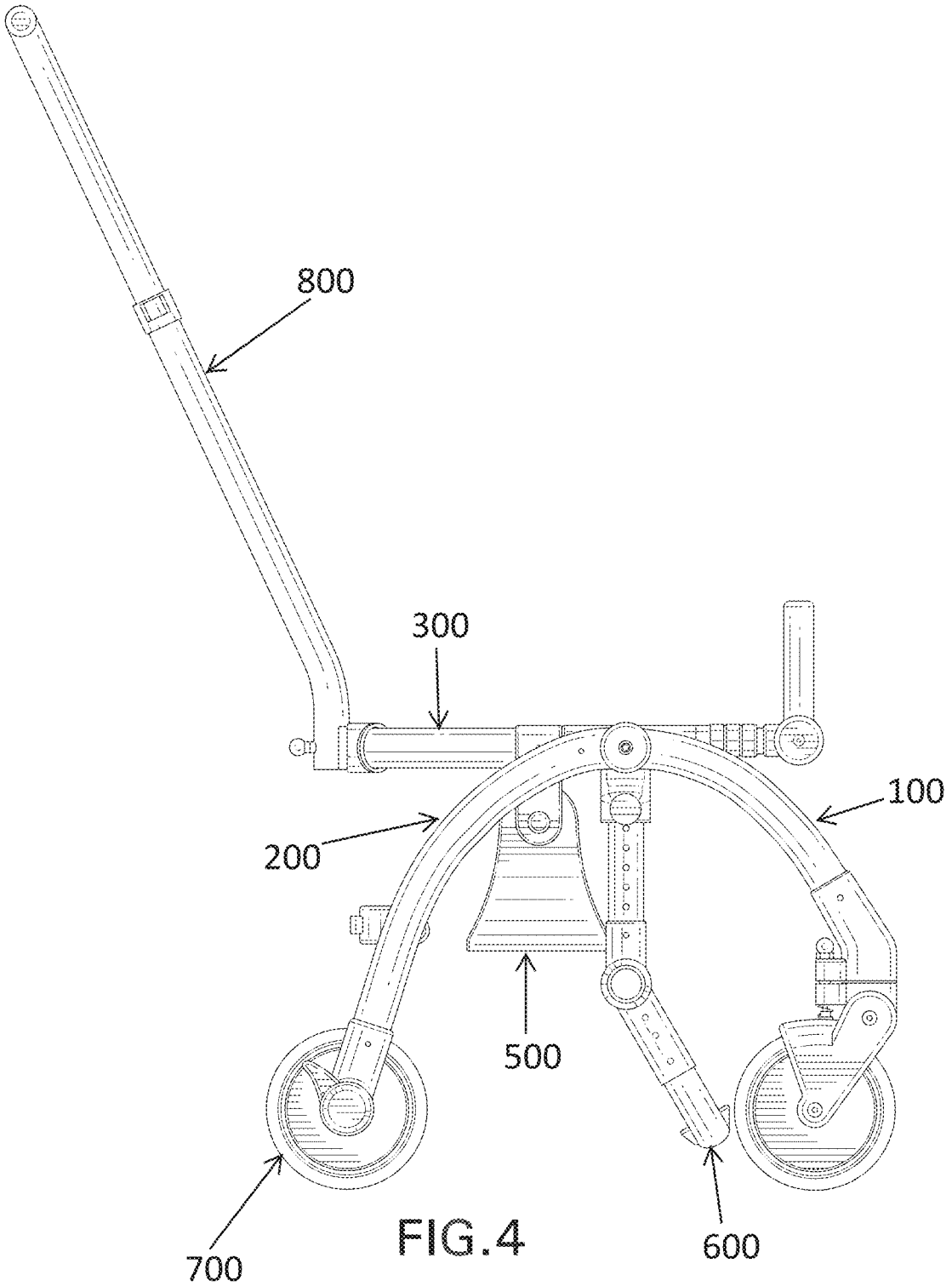
FIG. 4 is a right-side view of the foldable walker apparatus.

As shown, the front legs 101, 102 are formed with an arcuate, e.g. undulating, shape, with each leg having a complimentary or mirroring shape with equivalent radii of curvature. For example, the legs 101, 102 can have a first radius of curvature $\alpha$ in the vertical plane such that the legs extend in parallel outwardly and downwardly as shown, and second radius of curvature $\beta$ in the horizontal plane such that the legs extend laterally inward transitioning into the first cross beam 103. The angle $\alpha$ can be less than, or shallower, than angle $\beta$ so that the legs 101, 102 project forward beyond the gait of the user, while the first cross beam 103 forms an approximately perpendicular orientation with respect to the legs 101, 102. The first cross beam 103 can lie in-plane with the legs 101, 102 as shown in side views of FIG. 4-5 (wherein the cross beam is obscured by the coplanar legs in the foreground of the view). Additionally, the first cross beam 103 can be located on the downward slope of the back end of undulating legs 101, 102. In this configuration, the first cross beam 103 is disposed at height that is lower than the apex 105, or point of inflection, of the legs 101, 102.

The front leg frame 100 can also include mounting bracket(s) 110 at the union/transition between legs 101, 102 and the first cross beam 103. These mounting brackets 110 can be located on the interior surface of this curvature/union and include an attachment structure (e.g. tongue/groove coupling) to couple the rear leg frame 200, as described in further detail herein.

Figure 11:
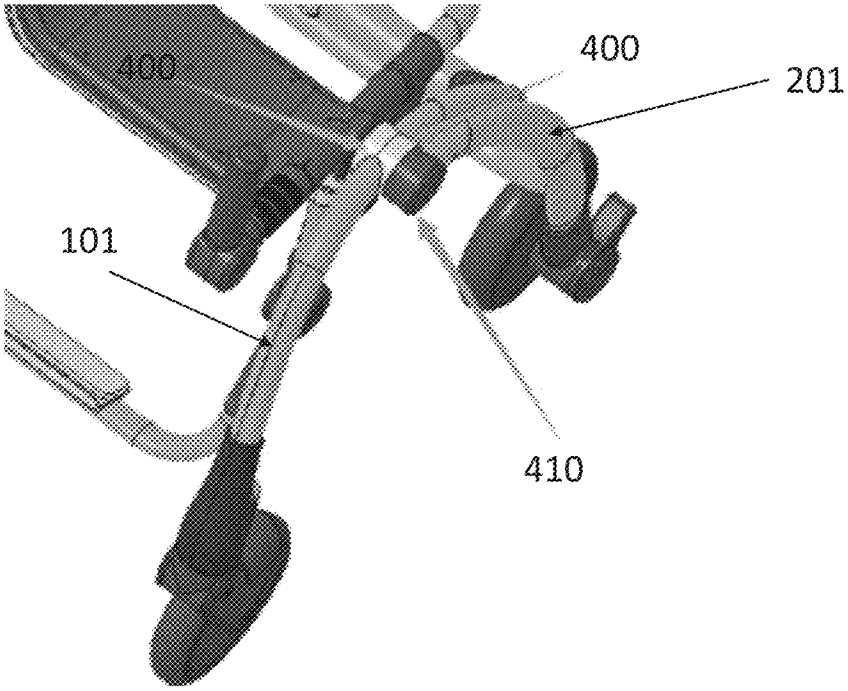
FIG. 11 is zoom-in enlarged view of the hinge joining the front leg frame and rear leg frame of the foldable walker apparatus.

Additionally, the front leg frame 100 can include a hinge 400 located thereon, e.g. at the apex of the undulating structure, as shown. The hinge 400 can include a locking and release mechanism (e.g. toothed gear) to releasably lock the front leg frame 100 to rear leg frame 200, as described in more detail herein. Additionally, the hinge 400 can be housed entirely on the front leg frame 100, as shown in FIG. 11, which provides enhanced structural rigidity in that loading is dispersed between the front leg frame 100, rear leg frame 200 and the hinge 400. Also, in the exemplary embodiment shown, a pin 401 protrudes laterally outward from the outer side of the hinge 400 and is configured to be received by a complimentary mating structure on the rear leg frame 200. On the inner side of the hinge 400 a receiving member 402, e.g. sleeve, is included and oriented in a vertical configuration to receive the height adjustment member of the footrest 600.

Also, the front leg frame 100 includes an actuator 120 located at a midpoint of the first cross beam 103. The actuator can be a spring loaded lock/release lever that unlocks the hinge 400 to permit relative movement between the front leg frame 100 and the rear leg frame 200. Upon actuation, the hinge pin 401 is retracted or released from the rear leg frame 200, and the front leg frame and rear leg frame 200 pivot about hinge 400 to bring the front and rear wheels towards each other thereby folding the walker apparatus. When the lock within the actuator 120 is engaged, relative movement between the front leg frame 100 and rear leg frame 200 is prohibited, thereby providing a safe environment for a child to operate the walker without risk of injury.

At the end of each leg 101, 102 is a wheel assembly 700. The wheels can be single discs that permit rotation of the wheel only about a horizontal axis 701 through the center of the disk. Additionally or alternatively, the wheel assembly can include a plurality of discs, e.g. pair of casters, and provide wheel-swivel, or steering of the walker apparatus, by permitting rotation of the wheels about a vertical axis 702 as well as horizontal axis 701. Additionally, the wheel(s) can be removably attached to the distal ends of the legs, and include a quick release pin 703 to provide a secure coupling between the wheel and leg. The pin 703 can also lock the wheels relative to the legs so as to control steerage of the walker apparatus (e.g. lock the wheels into a single, forward-only, direction of movement). In some embodiments, the pin 703 is spring activated. Moreover, the wheels can include a shroud 705 that provides a braking mechanism and/or lock to restrict or prevent undesired movement of the apparatus.

Rear Leg Frame 200

Figure 10:
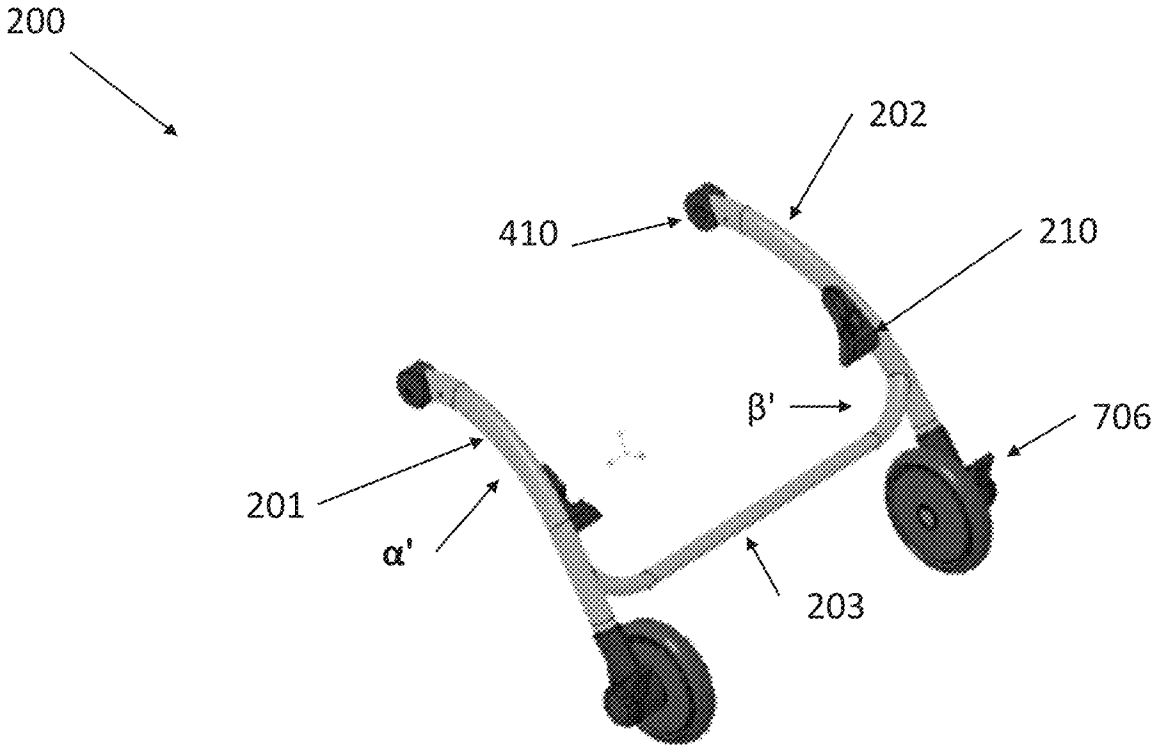
FIG. 10 is an isolated and perspective view of the rear leg frame of the foldable walker apparatus.

An exemplary embodiment of the rear leg frame 200 is shown, in isolation for clarity in FIG. 10, as having a first and second front legs 201, 202, respectively. The front leg frame 200 also includes second cross beam 203 extending between and connecting the rear legs 201, 202. As shown, these components can be integrally formed as a single unit. Alternatively, these components can be formed individually and joined (e.g. welded, adhesive, mechanical fasteners, etc.) into a sub-assembly.

As shown, the rear legs 201, 202 are formed with an arcuate shape with each leg having a complimentary or mirroring shape with equivalent radii of curvature. For example, the legs 201, 202 can have a first radius of curvature $\alpha'$ in the vertical plane such that the legs extend in parallel outwardly and downwardly as shown, and second radius of curvature $\beta'$ in the horizontal plane such that the legs extend laterally inward transitioning into the first cross beam 103. The angle $\alpha'$ can be less than, or shallower, than angle $\beta'$ so that the legs 201, 202 project rearward beyond the gait of the user, while the second cross beam 203 forms an approximately perpendicular orientation with respect to the legs 201, 202. The second cross beam 203 can lie in-plane with the legs 201, 202 as shown in side views of FIG. 4-5 (wherein the cross beam is obscured by the coplanar legs in the foreground of the view). Additionally, the second cross beam 203 can be located on the downward slope of the back end of legs 201, 202 to form a generally H-shaped structure. In this configuration, the second cross beam 203 is disposed at height that is proximate the end of the legs 201, 202 and disposed just above the wheels.

Figure 3:
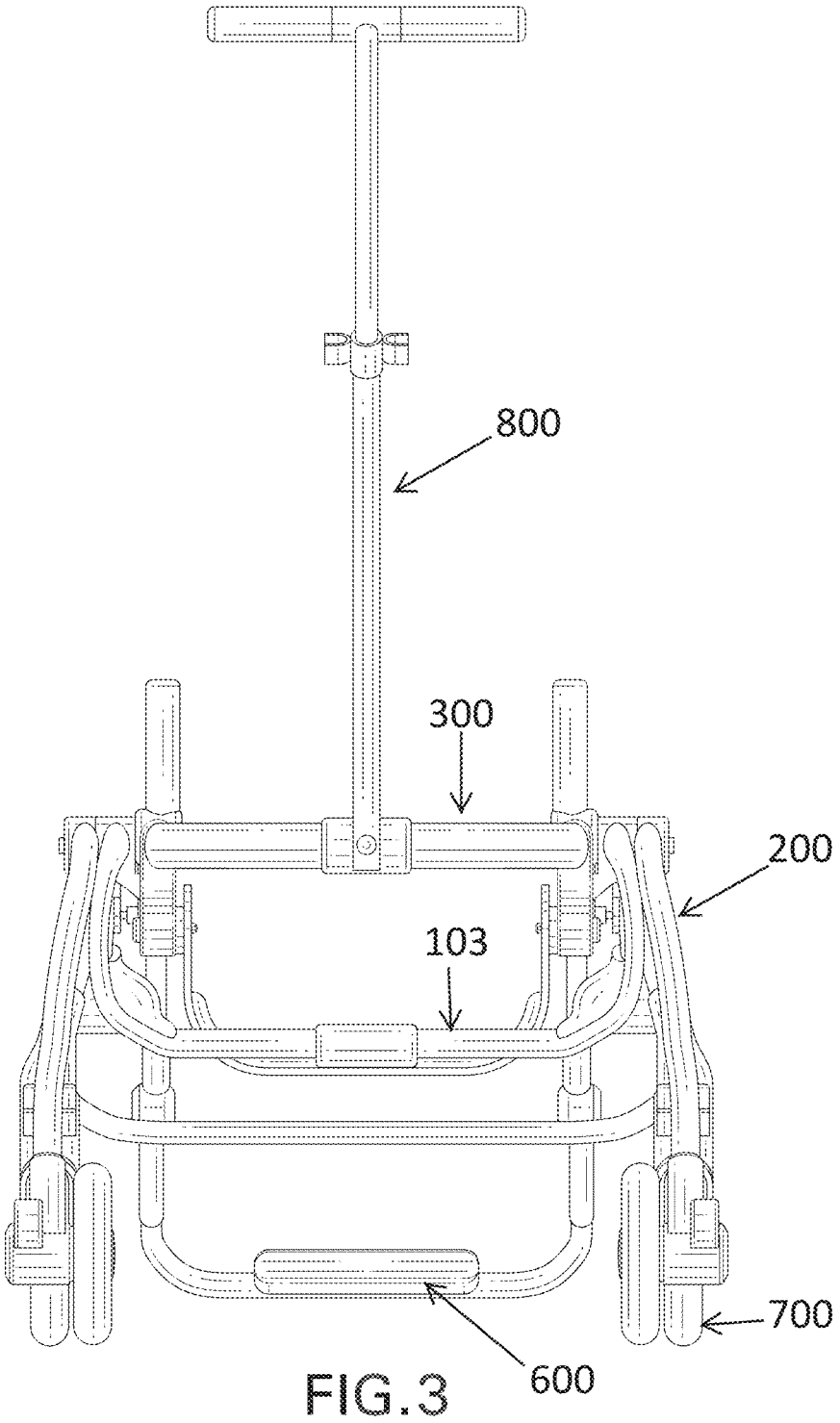
FIG. 3 is a rear view of the foldable walker apparatus.
Figure 6:
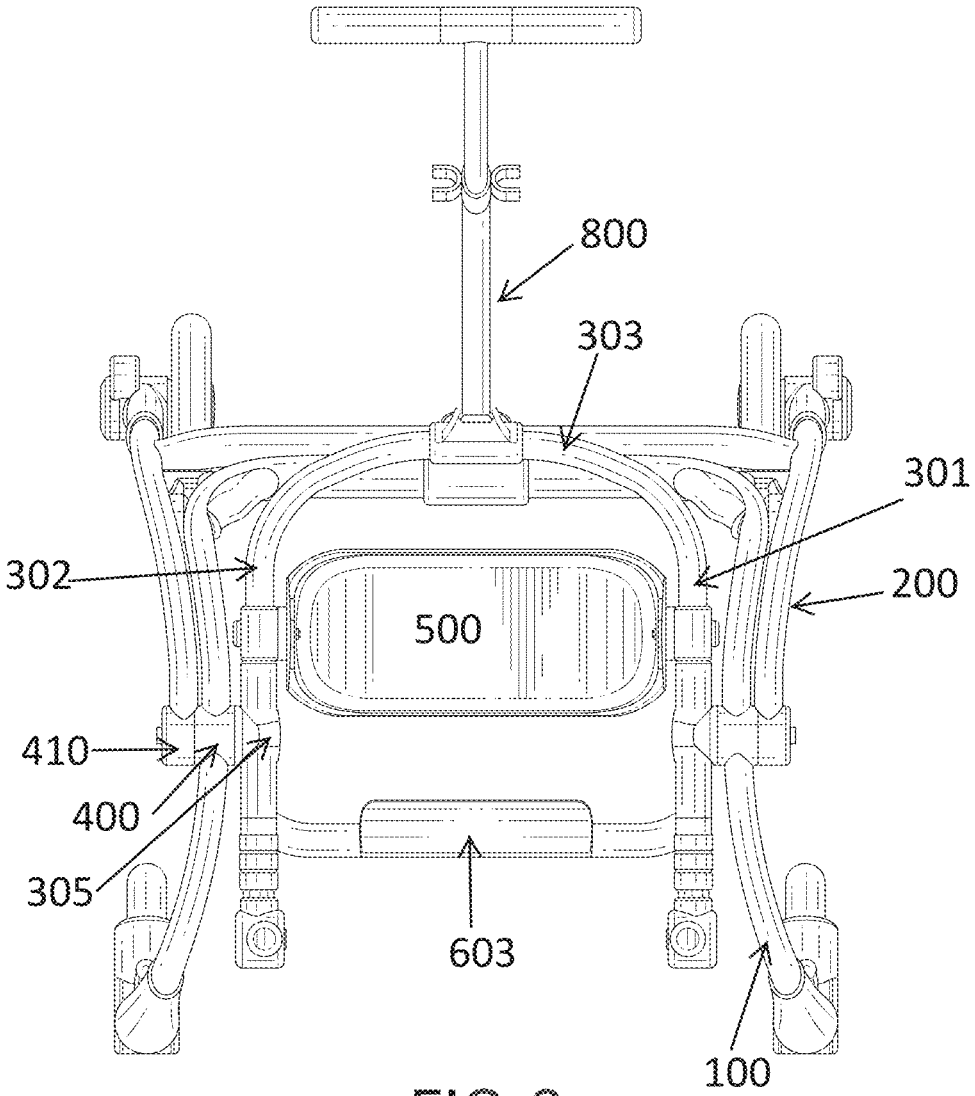
FIG. 6 is a top view of the foldable walker apparatus.
Figure 7:
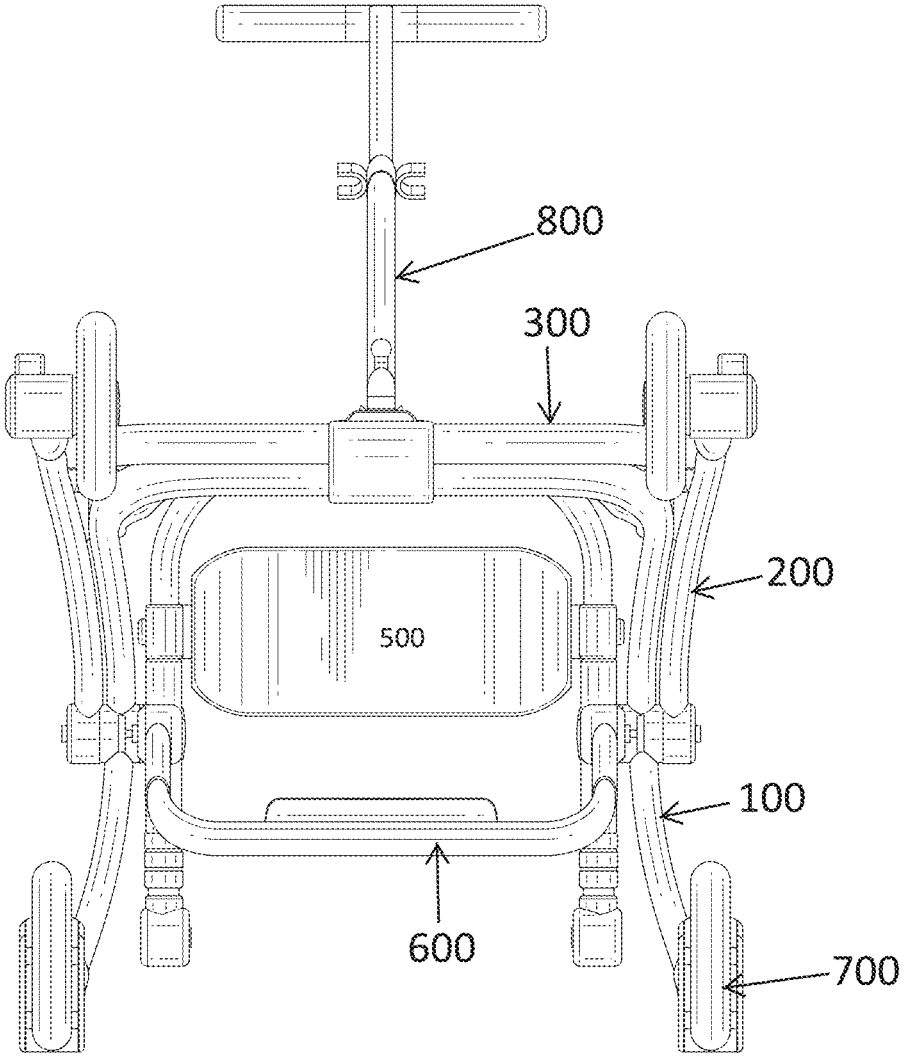
FIG. 7 is a bottom view of the foldable walker apparatus.

As best shown in FIGS. 3 and 6, the legs 201, 202 of the rear leg frame are disposed external to, or laterally outward, from the legs 101, 102 of the front leg frame. Additionally, the second cross beam 203 of the rear leg frame is disposed below the first cross beam 103 of the front leg frame.

The rear leg frame 200 can also include mounting bracket(s) 210 above the union/transition between legs 201, 202 and the second cross beam 203. These mounting brackets 210 can be located on the interior surface of the legs and include an attachment structure (e.g. tongue/groove coupling) to couple the front leg frame 100, e.g. via interference fit, as described in further detail herein. The brackets 201 on the rear leg frame can engage with the brackets 110 on the front leg frame to secure the two frames together. The union of these brackets can be released upon depressing the actuator 120.

Additionally, the rear leg frame 200 can include a housing 410 located thereon, e.g. at the front end of the legs 201, 202, as shown. The housing 410 can include a recess or aperture to matingly and releasably receive the pin 401 protruding from the hinge 400 on the front leg frame 100.

Similarly to the front leg frame described above, at the end of each leg 201, 102 of the rear leg frame is a wheel assembly 700. The wheels can be configured in the same manner(s) as described above with respect to the front leg frame 100. Additionally, the wheels on the rear legs can include locking levers 706 that extend upwardly/outwardly so as to be easily operated, e.g. by the foot of an adult standing outside/behind the walker apparatus.

Upper Frame 300

An exemplary embodiment of the rear upper frame 300 is best shown in FIG. 6, as having a left and right side arm 301, 302, respectively. The upper frame 300 also includes third cross beam 303 extending between and connecting the side arms 301, 302. The third cross beam 303 is disposed above the first cross beam 103, which is disposed above the (lowest) second cross beam 203. As shown, these components can be integrally formed as a single unit. Alternatively, these components can be formed individually and joined (e.g. welded, adhesive, mechanical fasteners, etc.) into a sub-assembly.

The upper frame 300 is designed to surround and support the user during use (i.e. walking and/or seated). The upper frame 300 is coupled to the front leg frame 100 via coupling 305 which coincides with the apex where hinge 400 is located, which in turn is coupled to the rear leg frame 200 via hinge 400 and housing 410 interconnection. Also co-located at this juncture is the height adjustment mechanism of the foot rest 600, described in further detail below.

In some embodiments, the upper frame 300 remains fixed during folding/opening of the apparatus. In other words, the components of the upper frame 300 do not alter their relative positions, instead it is the front leg frame and rear leg frame which change positions to adjust between open and folded positions.

Figure 8:
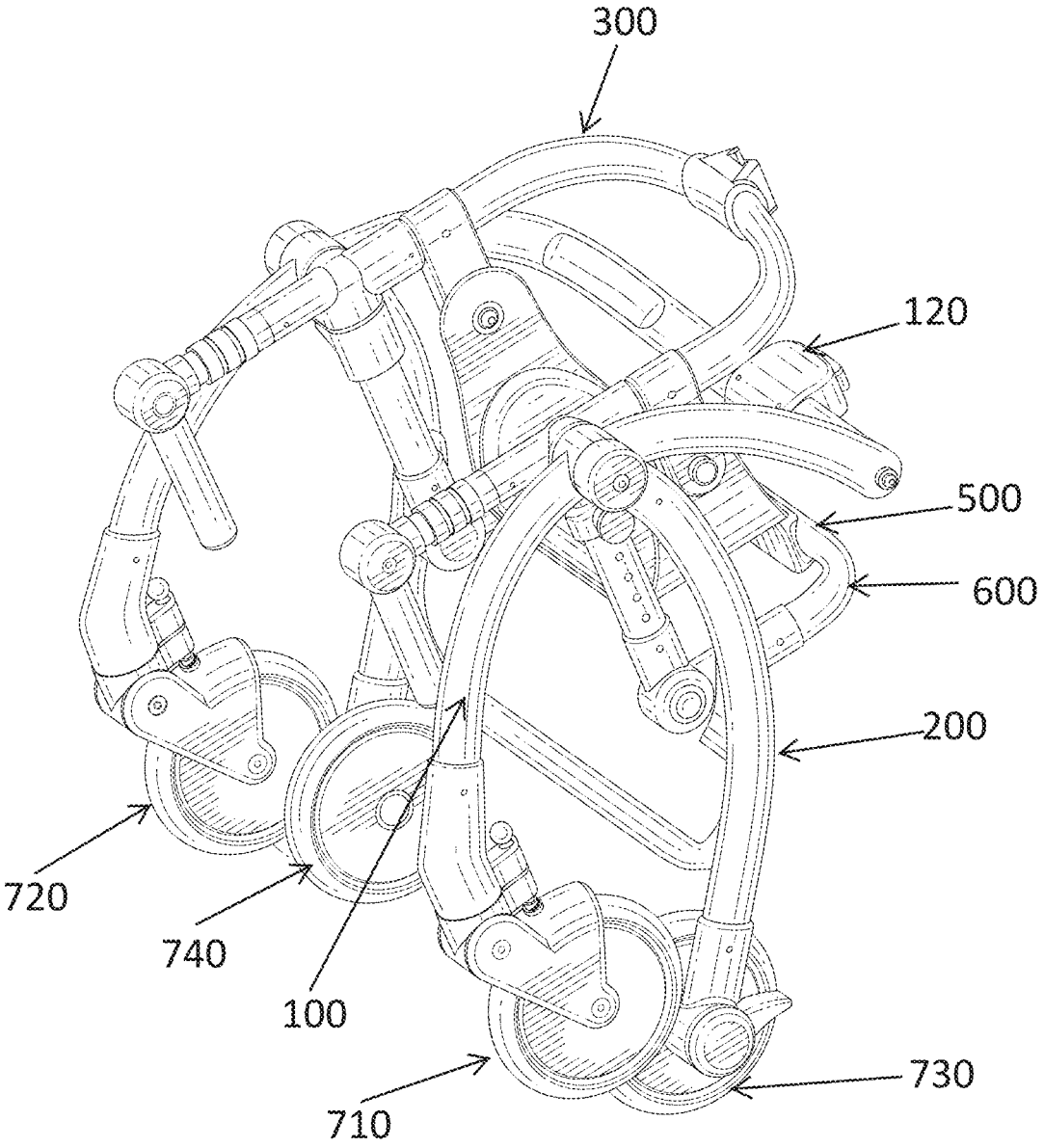
FIG. 8 is a perspective view of the foldable walker apparatus, shown in the folded or collapsed configuration.
Figure 12:
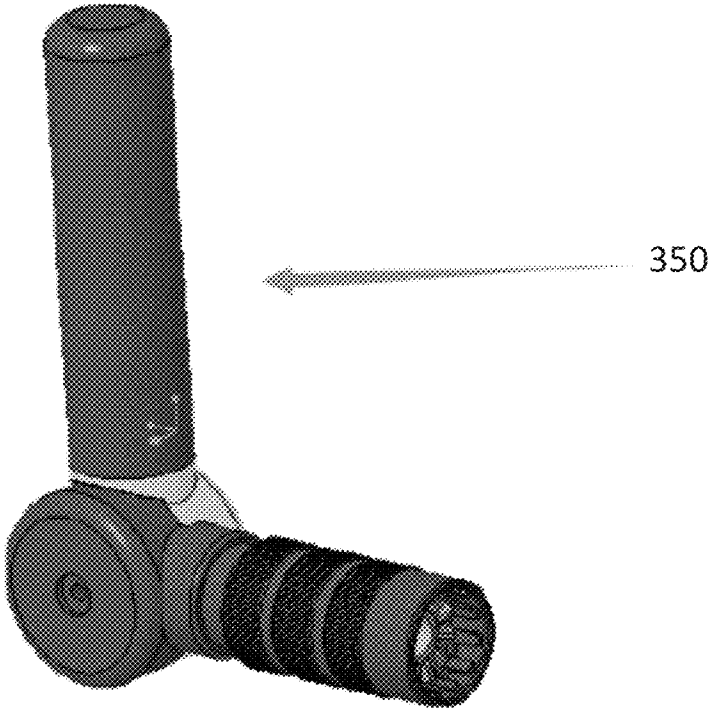
FIG. 12 is an isolated and perspective view of a handle of the foldable walker apparatus.
Figure 13B:
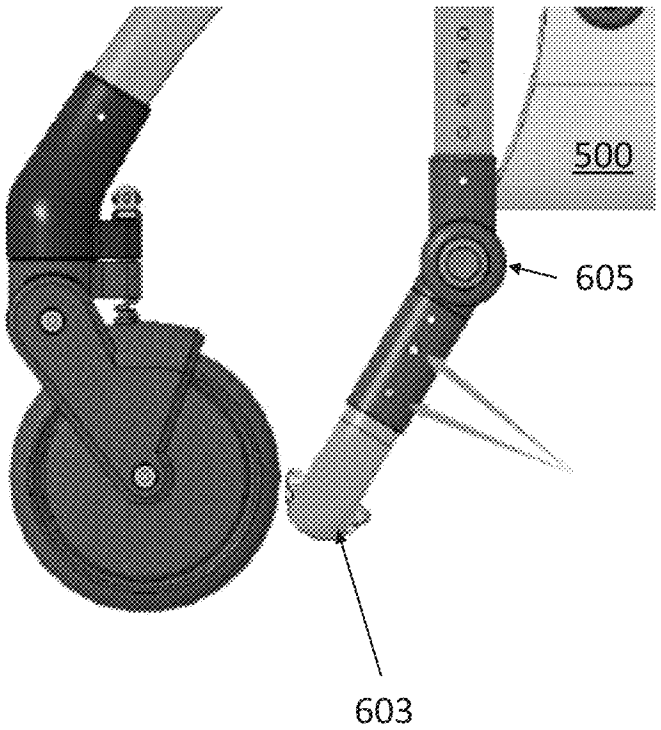
FIG. 13B is a zoom in enlarged view of the foot rest and wheel of the foldable walker apparatus.
Figure 13A:
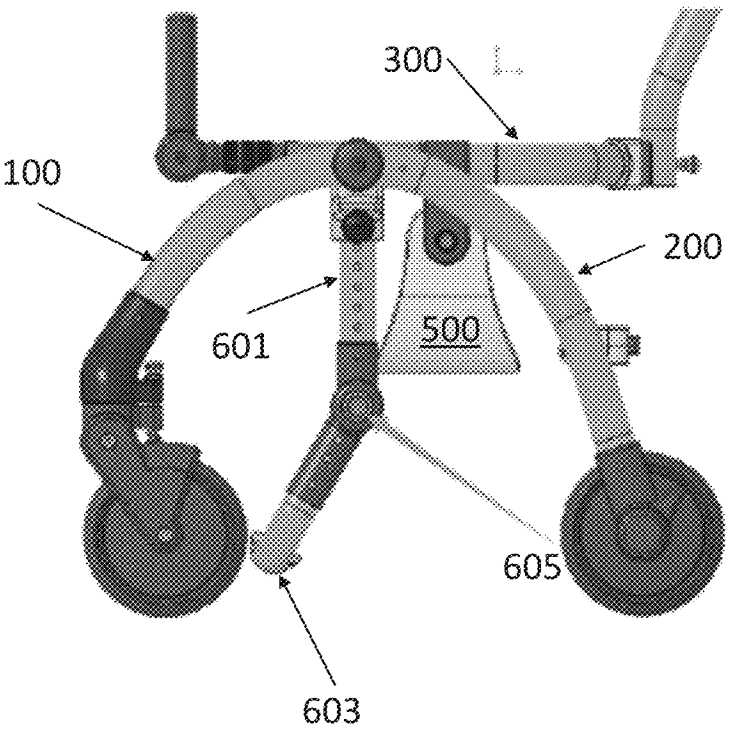
FIG. 13A is a left-side view of the foldable walker apparatus.

Handles 351, 352 can be included at the front end of the side arms 301, 302, respectively. An isolated view of an exemplary handle 350 is provided in FIG. 12. A user can steer the apparatus by pointing the handles in the desired direction of travel and propel the walker with their feet. In some embodiments, the handles can be in communication with the wheel brakes (e.g. via cabling routed through the hollow frame members) to provide breaking and/or locking (e.g. upon twisting a handle(s) clockwise or counterclockwise). Each handle can be adjustable in the pitch, yaw and roll directions (i.e. about X, Y and Z axes) over a 360 degree range of motion, and independently moved relative the other. When in the closed position, the handles can be rotated downwardly, as shown in FIG. 8, to minimize the profile of the walker apparatus. Additionally or alternatively, the handles can be replaced or retrofitted with a bumper bar which extends completely across the upper frame 300 so as to securely retain the child within the walker, if so desired.

Adjustable Footrest 600

An exemplary embodiment of the adjustable foot rest assembly 600 is best shown in FIGS. 4-5 and 13A-B, including a height adjustment mechanism having a left and right legs 601, 602, respectively, and a foot rest 603 extending therebetween and connecting the side legs 601, 602. In the embodiment shown, the legs 601, 602 extend vertically downward from upper frame 300 and have an ankle portion that includes a releasable lock 605 that allows for the foot rest 603 to be pivotably adjusted to accommodate and support the weight a user's foot (during seated operation of the walker). In the embodiment shown, the foot rest 603 extends the entire distance between legs 601, 602. In some embodiments the foot rest 603 can be configured as two separate members spaced from each other and coupled to the legs 601, 602, with a gap therebetween, to allow a greater range of unobstructed movement by the user's legs/feet (as well as independent vertical positioning—i.e. one foot rest can be positioned higher than the other if desired).

The releasable lock 605 of ankle portion can be adjusted vertically be sliding up/down to the desired location (see pin/hole locations in FIGS. 13A-B) and locked in place. Similarly, the foot support beam 603 can be extended/retracted to the desired location (see pin/hole locations in FIGS. 13A-B) and locked in place. When in the walking mode, or when folding of the walker is desired, the foot support beam 603 can be rotated counterclockwise about the ankle 605 (as shown in phantom in FIG. 5) so that the support beam 603 is disposed behind the user's legs and does not obstruct the user's gait.

Adjustable Support Surface 500

An exemplary embodiment of the adjustable support surface 500, which can function as a seat (as shown in FIGS. 1-4) or as a backrest (as shown in phantom in FIG. 5) includes left and right wings that are pivotably attached to the upper frame 300. In the exemplary embodiment shown, the support surface 500 is coupled to the left and right arms 301, 302 of the upper frame at a location aft of the hinge 400. This positioning of the support surface 500 is advantageous in that it allows for improved weight distribution through the hinge and down the front 100 and rear 200 leg frames.

Figure 15:
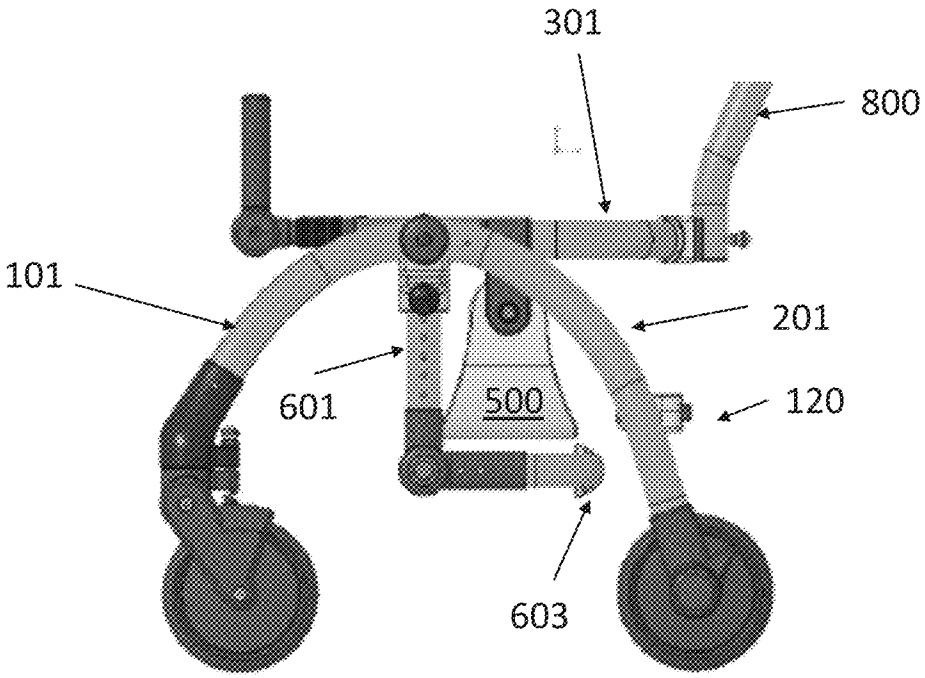
FIG. 15 is a left side view of the foldable walker apparatus, with the foot rest shown in the retracted position.
Figure 16:
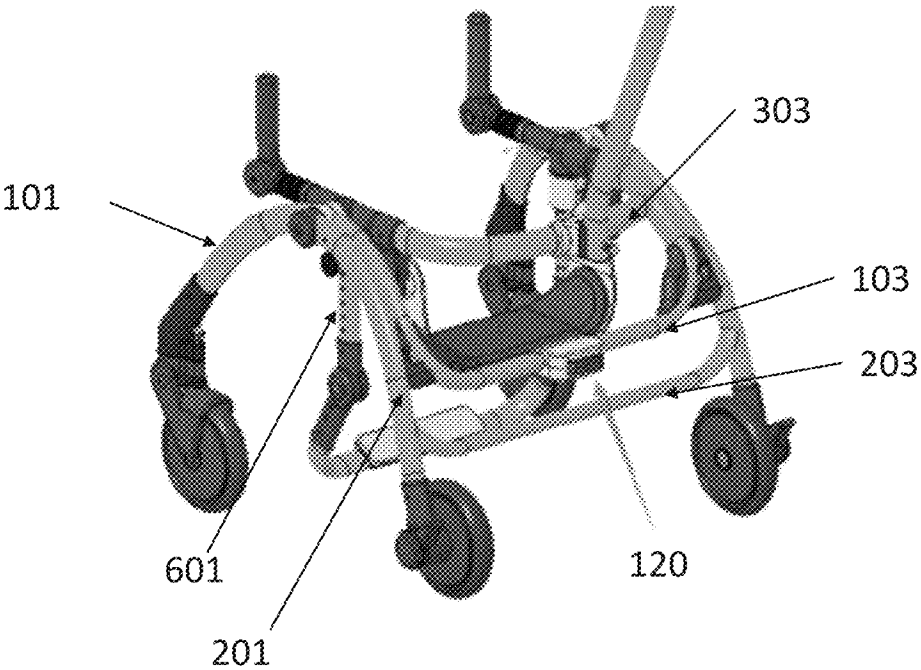
FIG. 16 is a rear perspective view of the foldable walker apparatus, shown in the open position.

The adjustable support surface 500 be positioned with the support surface parallel to the upper frame 300 (and ground) to serve as a seat and support the entirety of the user's weight. In this configuration, the foot rest 600 can be extended in a forward position to receive the user's feet (as shown in FIG. 1), and/or alternatively repositioned such that the foot rest 600 is retracted and parallel with the support surface (seat) 500 (as shown in FIG. 15).

Figure 5:
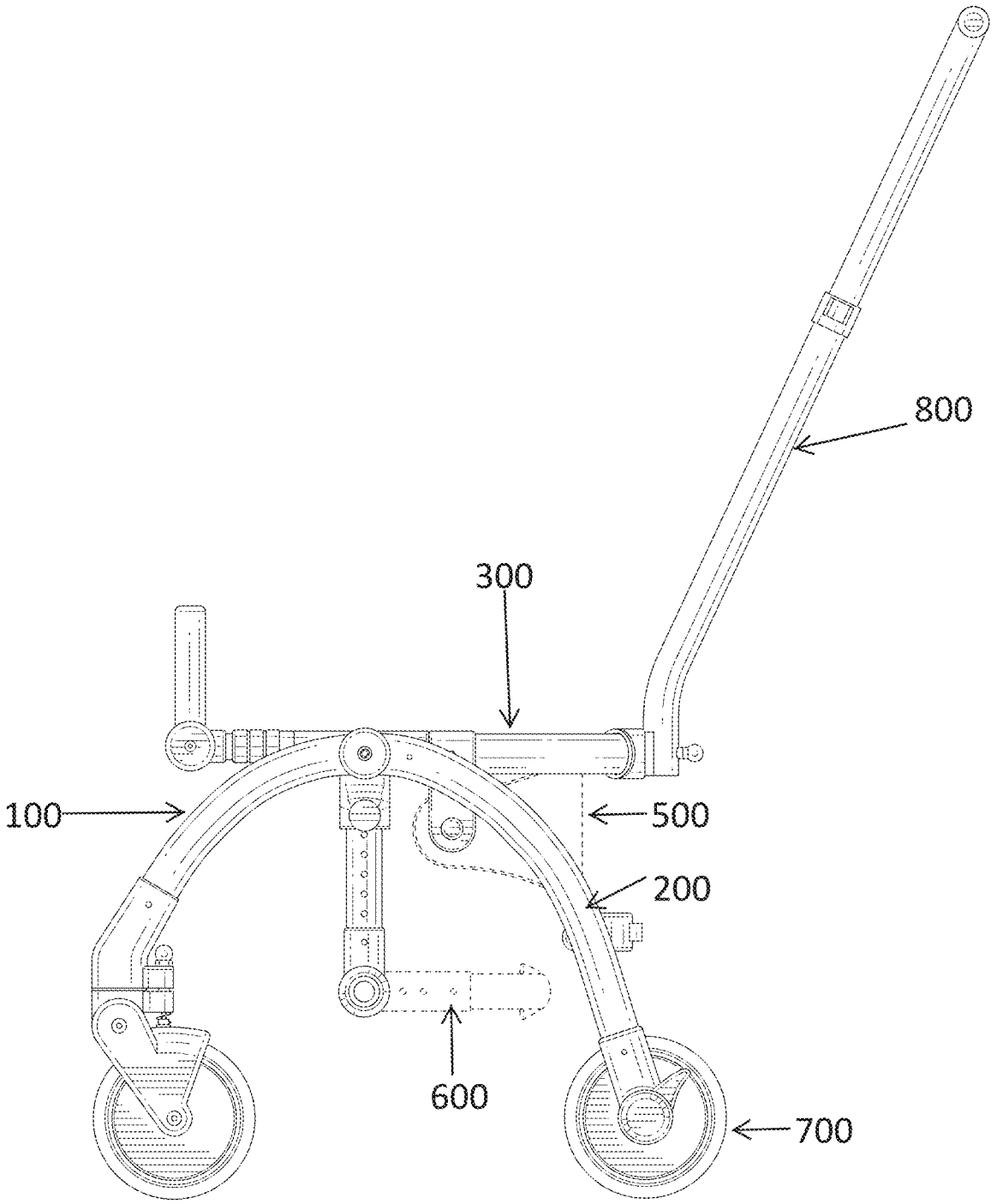
FIG. 5 is a left-side view of the foldable walker apparatus, showing the retracted position of the support surface and foot rest in phantom.
Figure 14:
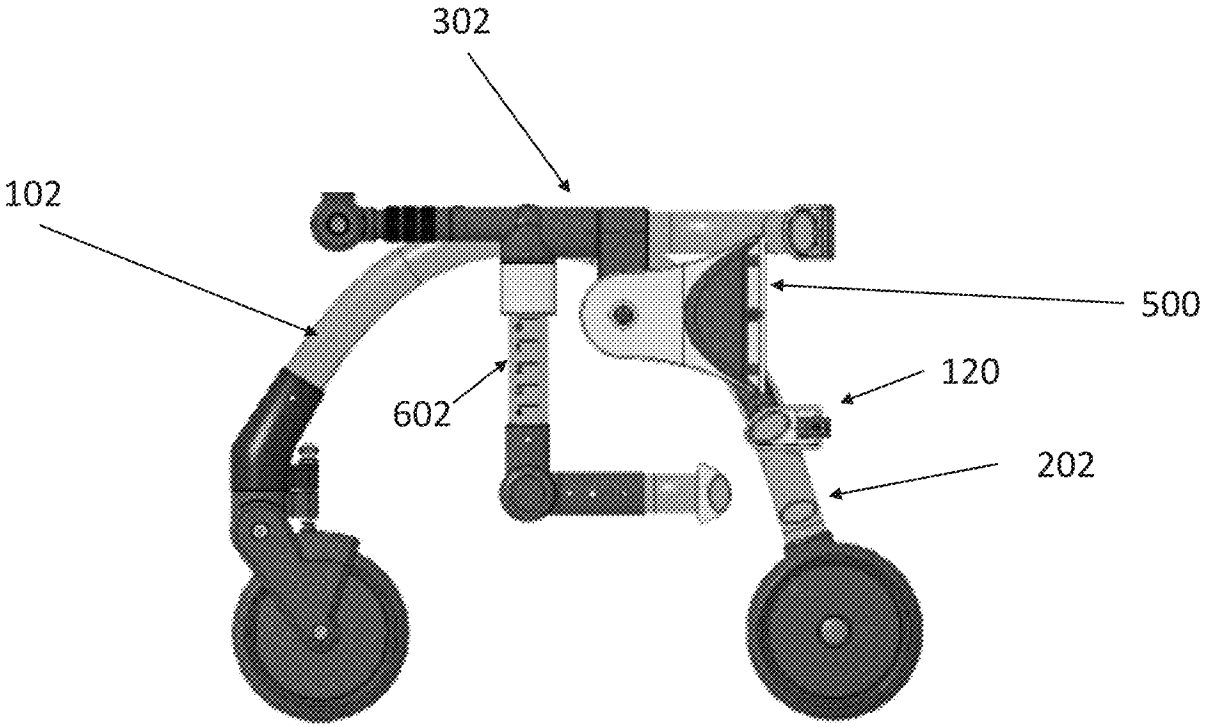
FIG. 14 is a left-side cross-sectional view of the foldable walker apparatus.

Additionally, the support surface can be adjusted or pivoted to orient the support surface perpendicular to the upper frame 300 (and ground) to serve as a back rest (as shown in FIG. 5) and remove any obstruction to the user's gait when walking. Also, when in the back rest position, i.e. the support surface 500 is positioned entirely within the boundaries defined by upper frame 300. In other words, the bottom/aft surface of the support surface 500 is positioned in front of the third cross beam 303, as shown in FIG. 14. Thus, the support surface 500 is able to swing or pivot from the horizontal to the vertical orientation without interference from any of the remaining components (e.g. front leg frame 100, rear leg frame 200, upper frame 300, foot rest 600).

Steering Extension 800

An exemplary embodiment of the steering extension 800 is shown throughout the views, and includes a boom or beam extending upwardly and rearwardly from the upper frame 300. The steering extension can be oriented at a variety of (fixed or adjustable) angles. In the exemplary embodiment shown, the steering extension 800 is oriented at approximately 65 degree angle with respect to the horizontal/ground plane. In some embodiments, the steering extension 800 is coupled to the third cross beam 303, at a location that is vertically aligned with the actuator 120 on the first cross beam 103 of the front leg frame. The steering extension 800 allows for adult supervision and/or control of the walker. For example, a guardian can stand behind the walker and grab the handle(s) of the steering extension to propel, and/or steer the walker. Additionally, a guardian can restrict or prohibit movement of the walker if desired. As shown, these components can be integrally formed as a single unit. Alternatively, these components can be formed individually and joined (e.g. welded, adhesive, mechanical fasteners, etc.) into a sub-assembly. In some embodiments the steering extension 800 is removable from the third cross beam 303, where it is connected when a parent wishes to control the walker, to a storage location on second cross beam 203 where it can be located when not in use so that the elongated beam is not an obstruction to a childs use (e.g. backward motion is not restricted, and no hazard is presented by the steering extension 800).

In operation, a user can easily, e.g. using one hand, convert the walker apparatus disclosed herein from the open configuration shown in FIG. 1. to the folded or collapsed configuration shown in FIG. 8. The user can move or retract the foot rest 600 (e.g. rotate counterclockwise from the forward/extended position shown in FIGS. 4 and 13, to the aft position shown in phantom FIGS. 5, 14-15). Optionally, the user can similarly move the seat support surface 500 (e.g. rotate counterclockwise from the horizontal seat position shown in FIGS. 1 and 13, to the vertical backrest position shown in FIG. 14). Also, optionally, the user can lock the wheel(s) as desired to prevent any undesired motion of the apparatus.

As shown in the open configuration, the front wheels are spaced from the rear wheels by a first distance which is large enough to exceed the gait of the child when positioned inside the walker (e.g. approximately 63 inches apart). The user can press the actuator 120 on the front leg frame to release the locked hinge 400 and permit relative movement between the front leg frame 100 and rear leg frame 200. Rear leg frame can then be advanced forward with the aft wheels 730, 740 approaching front wheels 710, 720 as shown in FIG. 8. In the fully collapsed or folded position, the front wheels 710, 720 can overlap with aft wheels 720, 740, with the front wheels positioned exterior or laterally outward of the aft wheels, as shown. If desired, the locking pin on the forward wheels 710, 720 can be retracted to allow the front wheels 710, 720 to rotate/swivel about the front legs 101, 102. Also, during this folding motion, the forwards wheels 710, 720 can be elevated with respect to the aft wheels 720, 740. Upper frame 300 can serve as a carrying bar/handle for easy transport of the folded walker.

The components described herein can be formed from a variety of materials provided they exhibit the requisite rigidity to support a user's weight during use, examples include metal, plastics, wood, etc. The components can be formed in a generally tubular form from a variety of techniques (e.g. molding, casting, 3D printing, etc.). The dimensions of these components can be fixed and sized according to target populations (e.g. age, height, weight, etc.). Additionally or alternatively, the various components (e.g. front leg frame, rear leg frame, upper frame, seat, footrest, etc.) can be formed with a mechanism to provide adjustable length. For example, the legs/beams of select, or all, frames can be formed with a telescopingly extendable tubular configuration to allow expansion/extension to accommodate a greater variety of customization.

While the disclosed subject matter is described herein in terms of certain preferred embodiments, those skilled in the art will recognize that various modifications and improvements may be made to the disclosed subject matter without departing from the scope thereof. Moreover, although individual features of one embodiment of the disclosed subject matter may be discussed herein or shown in the drawings of the one embodiment and not in other embodiments, it should be apparent that individual features of one embodiment may be combined with one or more features of another embodiment or features from a plurality of embodiments.

In addition to the specific embodiments claimed below, the disclosed subject matter is also directed to other embodiments having any other possible combination of the dependent features claimed below and those disclosed above. As such, the particular features presented in the dependent claims and disclosed above can be combined with each other in other manners within the scope of the disclosed subject matter such that the disclosed subject matter should be recognized as also specifically directed to other embodiments having any other possible combinations. Thus, the foregoing description of specific embodiments of the disclosed subject matter has been presented for purposes of illustration and description. It is not intended to be exhaustive or to limit the disclosed subject matter to those embodiments disclosed.

It will be apparent to those skilled in the art that various modifications and variations can be made in the method and system of the disclosed subject matter without departing from the spirit or scope of the disclosed subject matter. Thus, it is intended that the disclosed subject matter include modifications and variations that are within the scope of the appended claims and their equivalents.

What is claimed is:

1. A foldable walker apparatus comprising:
- a front leg frame, the front leg frame including:
  - a first front leg, the first front leg having at least one wheel coupled thereto,
  - a second front leg, the second front leg having at least one wheel coupled thereto;
  - a first cross beam, the first cross beam connecting the first front leg to the second front leg;
- a rear leg frame, the rear leg frame including:
  - a first rear leg, the first rear leg having at least one wheel coupled thereto,
  - a second rear leg, the second rear leg having at least one wheel coupled thereto;
  - a second cross beam, the second cross beam connecting the first rear leg to the second rear leg;
- a hinge, the hinge pivotably coupling the front leg frame to the rear leg frame;
- an upper frame, the upper frame including:
  - a left side arm having a handle at the distal end,
  - a right side arm having a handle at the distal end,
  - a third cross beam, the third cross beam connecting the left side arm to the right side arm; and
- a foot rest, the foot rest coupled to a height adjustment mechanism wherein the foot rest is positioned parallel to the support surface when the support surface is in the horizontal seat position
- wherein the apparatus can be converted between an open configuration with the front wheel(s) spaced a first distance from the rear wheel(s), and a folded configuration in which the front wheel(s) are spaced a second distance from the rear wheel(s).

2. The apparatus of claim 1, further comprising a support surface pivotably coupled to the left and right side arms, the support surface convertible from a horizontal seat position to a vertical backrest position.

3. The apparatus of claim 2, further comprising a foot rest, the foot rest coupled to a height adjustment mechanism.

4. The apparatus of claim 3, wherein the foot rest is pivotably adjustable.

5. The apparatus of claim 3, wherein the height adjustment mechanism is coupled to the left and right side arms of the upper frame.

6. The apparatus of claim 1, wherein the first front leg, second front leg and first cross beam are integrally formed.

7. The apparatus of claim 1, wherein the first rear leg, second rear leg and second cross beam are integrally formed.

8. The apparatus of claim 1, wherein the hinge is disposed on the front leg frame.

9. The apparatus of claim 1, further comprising an actuator, the actuator releasably locking the front leg frame with respect to the rear leg frame between open and folded configurations.

10. The apparatus of claim 9, wherein the actuator is disposed on the first cross beam.

11. The apparatus of claim 1, wherein the wheels are swiveling casters.

12. The apparatus of claim 1, wherein the wheels include a break mechanism.

13. The apparatus of claim 1, wherein the wheels are removable.

14. The apparatus of claim 1, wherein the first cross beam is disposed vertically between the second cross beam and the third cross beam.

15. The apparatus of claim 1, wherein the first rear leg of the rear leg frame is disposed laterally outward from the first front leg of the front leg frame.

16. A foldable walker apparatus comprising:
- a front leg frame, the front leg frame including:
  - a first front leg, the first front leg having at least one wheel coupled thereto,
  - a second front leg, the second front leg having at least one wheel coupled thereto;
  - a first cross beam, the first cross beam connecting the first front leg to the second front leg;
- a rear leg frame, the rear leg frame including:
  - a first rear leg, the first rear leg having at least one wheel coupled thereto,
  - a second rear leg, the second rear leg having at least one wheel coupled thereto;
  - a second cross beam, the second cross beam connecting the first rear leg to the second rear leg;
- a hinge, the hinge pivotably coupling the front leg frame to the rear leg frame;
- an upper frame, the upper frame including:
  - a left side arm having a handle at the distal end,
  - a right side arm having a handle at the distal end,
  - a third cross beam, the third cross beam connecting the left side arm to the right side arm; and
- wherein the apparatus can be converted between an open configuration with the front wheel(s) spaced a first distance from the rear wheel(s), and a folded configuration in which the front wheel(s) are spaced a second distance from the rear wheel(s);
- wherein the handles are adjustable in pitch, yaw and roll directions.

17. The apparatus of claim 1, wherein the first front leg and second front leg of the front leg frame are arcuate in shape.

18. The apparatus of claim 1, wherein the first rear leg and second rear leg of the rear leg frame are arcuate in shape.

19. A foldable walker apparatus comprising:
- a front leg frame, the front leg frame including:
  - a first front leg, the first front leg having at least one wheel coupled thereto,
  - a second front leg, the second front leg having at least one wheel coupled thereto;

a first cross beam, the first cross beam connecting the first front leg to the second front leg;

a rear leg frame, the rear leg frame including:

a first rear leg, the first rear leg having at least one wheel coupled thereto, a second rear leg, the second rear leg having at least one wheel coupled thereto;

a second cross beam, the second cross beam connecting the first rear leg to the second rear leg;

a hinge, the hinge pivotably coupling the front leg frame to the rear leg frame;

an upper frame, the upper frame including:

a left side arm having a handle at the distal end, a right side arm having a handle at the distal end, a third cross beam, the third cross beam connecting the left side arm to the right side arm; and wherein the apparatus can be converted between an open configuration with the front wheel(s) spaced a first distance from the rear wheel(s), and a folded configuration in which the front wheel(s) are spaced a second distance from the rear wheel(s); and a steering extension, the steering extension extending upwardly and rearwardly from the third cross beam.

* * * * *